US006564873B1

(12) United States Patent
Tilbrook et al.

(10) Patent No.: US 6,564,873 B1
(45) Date of Patent: May 20, 2003

(54) APPARATUS FOR OFFSHORE PRODUCTION OF HYDROCARBON FLUIDS

(76) Inventors: Andrew Peter Tilbrook, Milton, Church Place, Pulborough West Sussex RH20 1AF (GB); David Bone, 5 Portwall Road, Chepstow, Monmouthshire NP6 5DL (GB); Paul Christopher Haywood, The Cottage, Oak Lawn, Woodside, Wootton, Isle of Wight PO33 4JR (GB); Nigel Barry Weir, 1 Brook Cottages, New Pond Road, Compton, Guildford GU3 1HX (GB)

( * ) Notice: Subject to any disclaimer, the term of this patent is extended or adjusted under 35 U.S.C. 154(b) by 0 days.

(21) Appl. No.: 09/269,692

(22) PCT Filed: Sep. 30, 1997

(86) PCT No.: PCT/GB97/02672

§ 371 (c)(1),
(2), (4) Date: Nov. 29, 1999

(87) PCT Pub. No.: WO98/14363

PCT Pub. Date: Apr. 9, 1998

(Under 37 CFR 1.47)

(30) Foreign Application Priority Data

Sep. 30, 1996 (GB) ..... 9620364

(51) Int. Cl.[7] ..... E21B 33/037; E21B 41/08

(52) U.S. Cl. ..... 166/356; 166/350; 405/207; 405/210; 405/224.2

(58) Field of Search ..... 166/345, 350, 166/352, 356, 357; 405/195.1, 205, 207, 210, 224, 224.1, 224.2

(56) References Cited

U.S. PATENT DOCUMENTS

| | | | | | |
|---|---|---|---|---|---|
| 3,568,737 | A | * | 3/1971 | Burns | 141/383 |
| 3,638,720 | A | * | 2/1972 | Thomas | 166/350 |
| 4,556,343 | A | * | 12/1985 | Cheung | 405/210 |
| 4,810,135 | A | * | 3/1989 | Davenport et al. | 405/224 |
| 4,813,815 | A | * | 3/1989 | McGehee | 405/202 |
| 6,382,320 | B1 | * | 5/2002 | Tilbrook et al. | 166/350 |

FOREIGN PATENT DOCUMENTS

| | | | | |
|---|---|---|---|---|
| EP | 0 494 497 | | 7/1992 | |
| GB | 2133446 | | 7/1984 | |
| GB | 2156283 | | 10/1985 | |
| GB | 2326655 | A * | 12/1998 | E21B/43/01 |

* cited by examiner

*Primary Examiner*—David Bagnell
*Assistant Examiner*—Jennifer H Gay
(74) *Attorney, Agent, or Firm*—Oppenheimer Wolff & Donnelly LLP

(57) ABSTRACT

An apparatus for offshore production of hydrocarbon fluids is disclosed. The apparatus comprises a base and a buoyant structure secured to said base and connected or adapted to be connected to a subsea well or wells. The key characteristics of the apparatus are that: (A) the apparatus includes storage facility means for fluid(s) received from the subsea well or wells and/or for processed fluid(s) produced by the apparatus; (B) the buoyant structure is tethered to the base by a plurality of flexible tethers; and (C) the buoyant structure comprises (i) a sub-surface housing containing facilities for processing fluids received from the subsea well or wells via said storage facility in said base; and (ii) a column extending upwardly from the housing to a level above the sea surface. The invention also relates to the buoyant structure per se.

5 Claims, 6 Drawing Sheets

5
2
16
1
6
7
8
9
10
11
12
15
13
14

APPARATUS FOR OFFSHORE PRODUCTION OF HYDROCARBON FLUIDS

BACKGROUND OF THE INVENTION

This invention relates to apparatus for the offshore production of hydrocarbon fluids and more particularly but not exclusively is concerned with such apparatus capable of operating unmanned and in a variety of sea depths including relatively deep operation.

SUMMARY OF THE INVENTION

According to one aspect of the present invention, there is provided an apparatus for offshore production of hydrocarbon fluids, comprising a base and a buoyant structure secured to said base and connected or adapted to be connected to a subsea well or wells, characterised in that: (A) the apparatus includes storage facility means for fluid(s) received from the subsea well or wells and/or for processed fluid(s) produced by the apparatus; (B) said buoyant structure is tethered to said base by a plurality of flexible tethers; and (C) said buoyant structure comprises (i) a sub-surface housing containing facilities for processing fluids received from the subsea well or wells via said storage facility in said base; and (ii) a column extending upwardly from said housing to a level above the sea surface.

The storage facility means is advantageously in the form of a storage vessel within the base. Alternatively, ancillary buoyant tethered storage units may be employed. The base may be a gravity structure or a piled structure. The buoyant structure may be connected directly to a wellhead, or via the base.

In another aspect, the invention provides a buoyant structure as defined above, the buoyant structure being adapted for connection to a base located on the sea bed and for processing of hydrocarbon fluids supplied to it from a subsea well or wells.

Preferably the main body of the submerged housing comprises a cylindrical section located between upper and lower conical body sections.

In a third aspect, the invention provides a buoyant structure for use in processing oil from a subsea well, which is characterised in that it comprises (i) a sub-surface housing containing facilities for processing fluids received from the subsea well or wells via said storage facility in said base; and (ii) a column extending upwardly from said housing to a level above the sea surface, and in that said sub-surface housing comprises a cylindrical section located between upper and lower conical body sections.

The buoyant structure of this invention is preferably arranged so that its submerged housing is positioned at a sub-surface depth of from 5 to 30 meters, more preferably 8 to 16 meters.

Advantageously, the buoyant structure will be positioned directly above the base, the latter incorporating a storage facility for hydrocarbon fluids. A connecting riser bundle, preferably in the form of a single common riser, can serve to connect the buoyant structure to the well or wells.

Preferred apparatus in accordance with this invention can be constructed to facilitate the production of hydrocarbon fluids from subsea wells at sub-surface depths typically from 200 to 1000 meters, although embodiments can also operate at depths in excess of 1000 meters.

Preferred apparatus in accordance with this invention can be operated unmanned, i.e., without requiring the presence of personnel on board the structure during normal operation. Typically, personnel will only be required on board the structure during specific periodical operations, for example, in order to replenish consumables and to carry out routine maintenance.

Preferred apparatus in accordance with this invention is suitable for extraction of, for example, oil from small and hitherto uneconomic deposits.

Preferably the buoyant structure is arranged to house all of the equipment needed to process fluids (received from the subsea well via the base) for delivery to a tanker for export from the apparatus.

In one embodiment, the buoyant structure is in the form of a vertically configures spar-type buoy. Such a structure may have a plurality of decks, for example, four, five or six decks.

In a second embodiment, the buoyant structure is in the form of a horizontally configured buoy having fewer decks than the first embodiment just described.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION OF PREFERRED EMBODIMENTS OF THE INVENTION

Figure 1A:
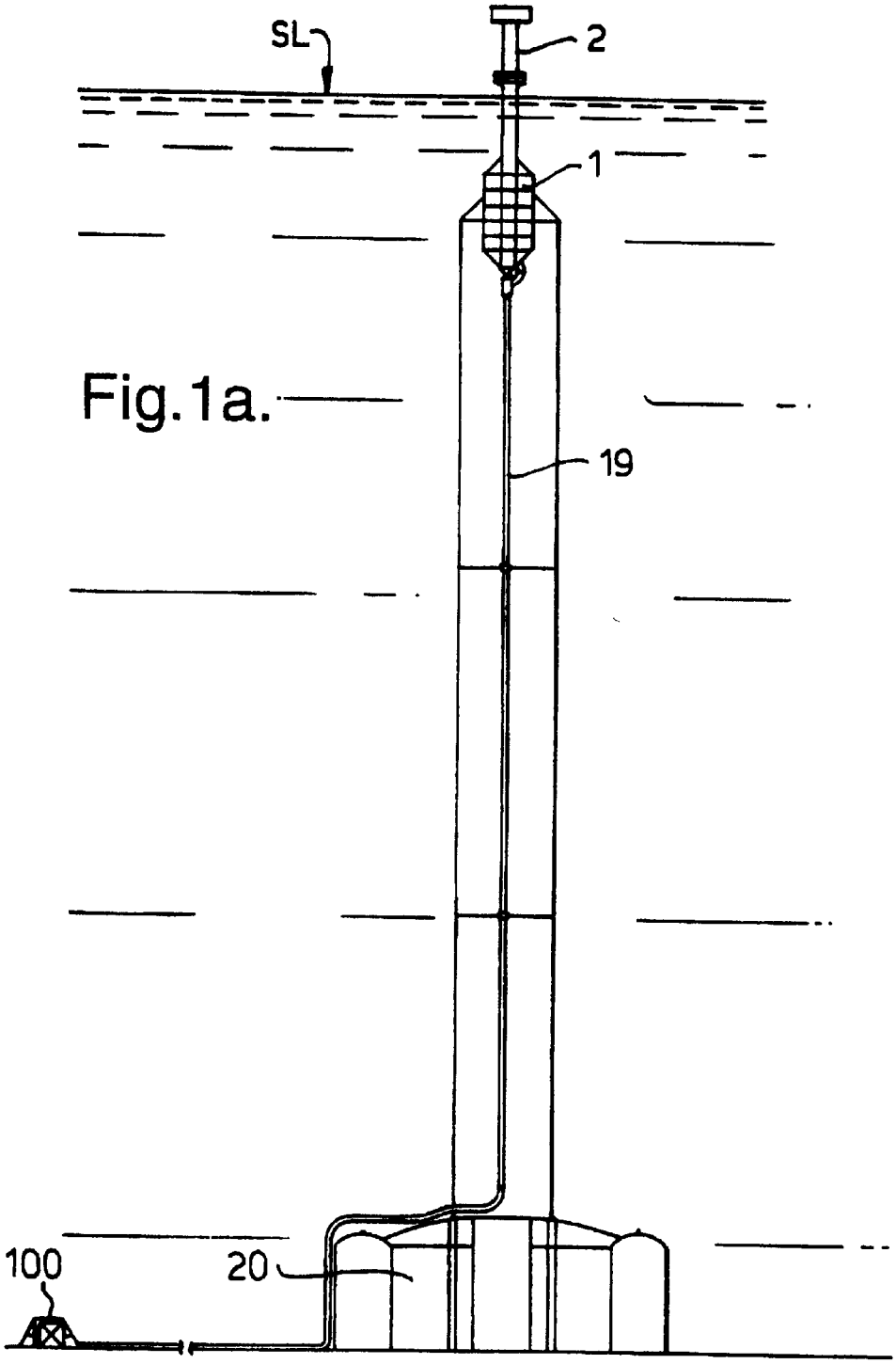
FIG. 1*a* is a schematic representation of an apparatus in accordance with this invention.
Figure 1B:
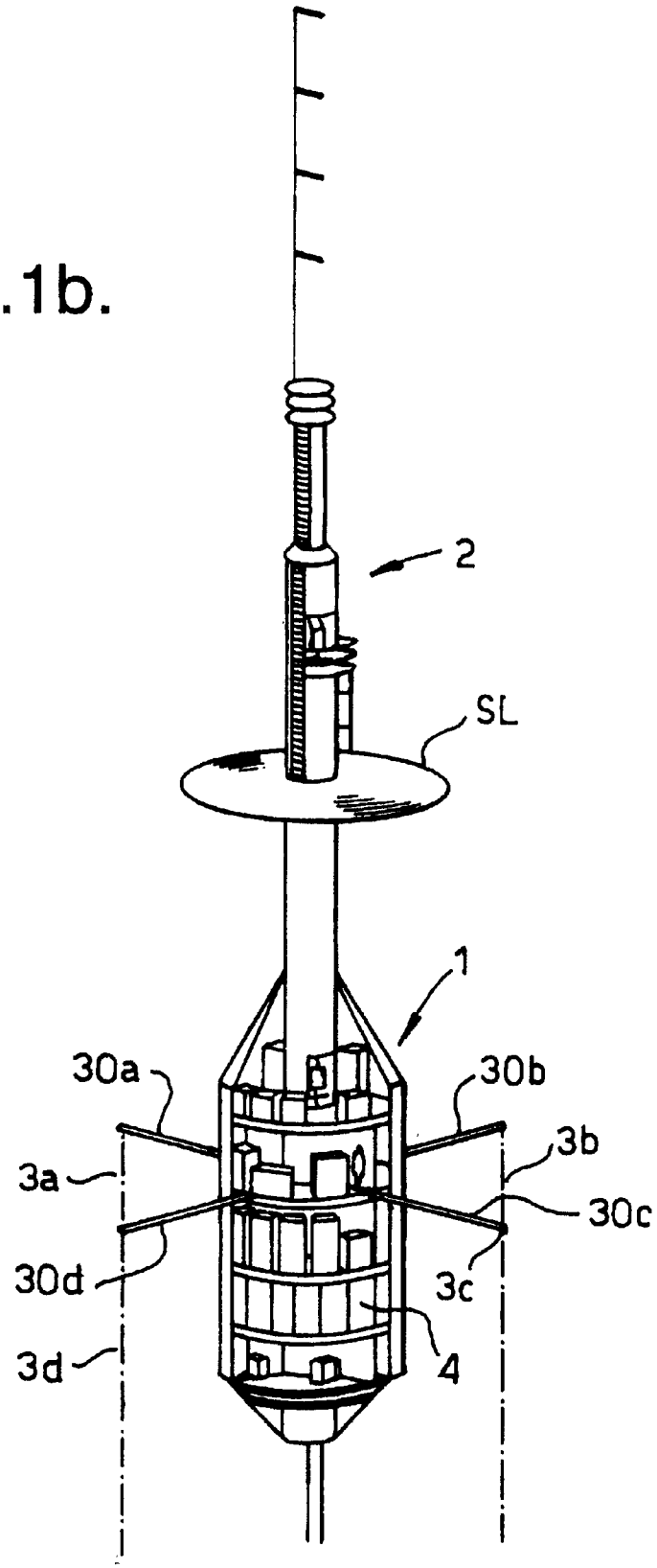
FIG. 1*b* shows the upper part of the apparatus of FIG. 1*a* in greater detail.

Referring to FIG. 1, a buoyant structure in accordance with this invention is shown, normal sea level being indicated by SL. The structure comprises a submerged housing 1 which supports a column 2 extending upwardly to a position well above sea level. The housing 1 is tethered by flexible tethers 3*a*–3*d* as shown and includes a plurality of decks such as 4. The number of tethers need not be four, as depicted here, but will be selected according to the intended location of the structure and the operating conditions likely to be encountered there. Advantageously the tethers are formed from spirally wound galvanized steel wire rope encased in an impermeable sheath of, for example, PVC or polyurethane. They are attached to the housing 1 via outriggers 30*a*–30*d* which may, for example, be in the form of tubular frames or spars. It is presently preferred to operate with two tethers per outrigger—i.e., eight tethers in this instance.

The housing 1 is connected via a riser 19 to a base 20 positioned on the sea bed and to wellhead 100. Base 20 is a gravity base with storage and separation facilities, as will be described hereinafter with reference to FIG. 4.

The use of flexible tethers (such as 3*a*–3*d*) is important in this invention because it provides for greater stability while also serving to minimise the stresses experienced by the riser 19 and the connections to it.

Figure 2:
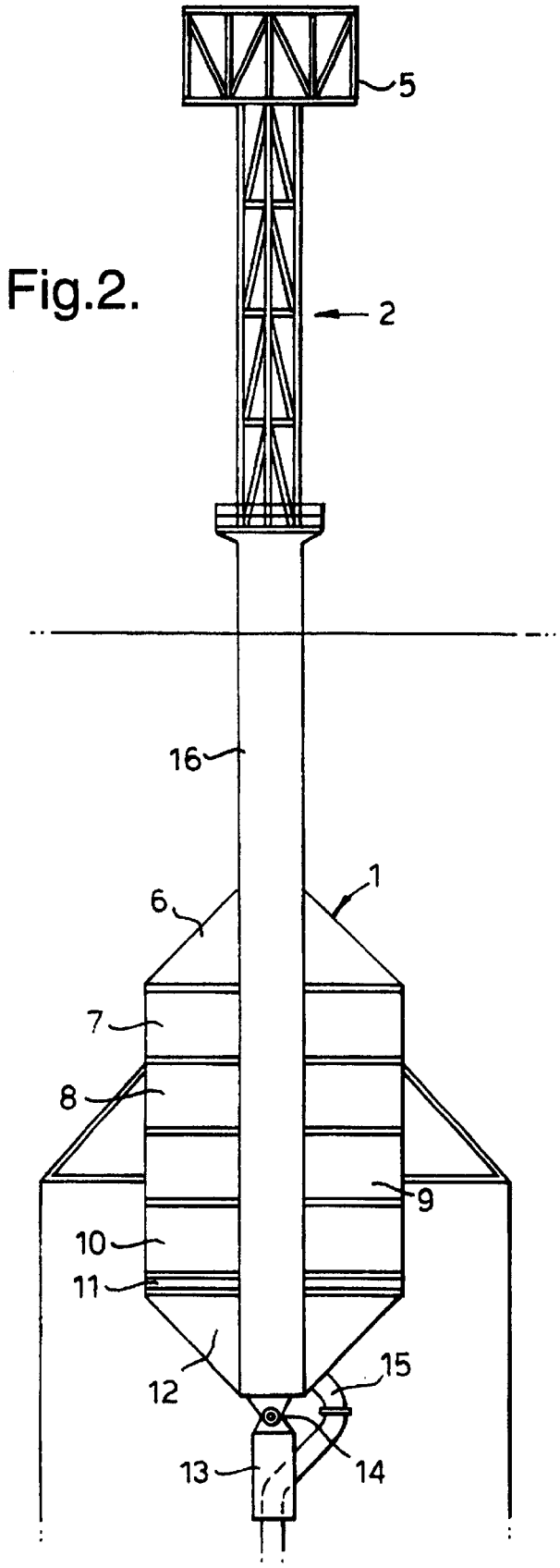
FIG. 2 illustrates one form of buoyant structure in accordance with the invention.

Referring now to FIG. 2, the upper part of this embodiment includes a topsides deck 5. The submerged housing 1 is arranged to be located at a depth of about 12 meters sub-surface and comprises vent/HVAC deck 6; H.P.U. deck 7; separator deck 8; ancillary deck 9; manifold deck 10; fluid deck 11; and pump deck 12. Hydrocarbon fluids are supplied to pump deck 12 via a supply line 15 located within riser 13. Riser 13 is attached to the housing 1 by universal joint 13. Riser 13 is attached to the housing 1 by universal joint 14.

The main deck areas of the housing 1 are delimited by watertight bulkheads. As shown, there are five decks (7–11) within the main, cylindrical body of the housing; and the uppermost deck 6 and lowermost deck 12 form upper and lower conical body sections.

A central shaft 16 passes through the body of housing 1 and provides access (via watertight doors, not shown) to all decks of the structure. Advantageously shaft 16 is relatively wide, e.g., about 3 meters, so as to permit any piece of equipment carried within the housing to be removed while the structure is in its normal operating position. Shaft 16 will typically contain HVAC conduits for each deck; a lift to permit human access to the decks; an emergency escape system, e.g., a ladderway; conduits for ventilation and replenishment of fluid tanks within the housing; and electrical cabling.

Figure 3:
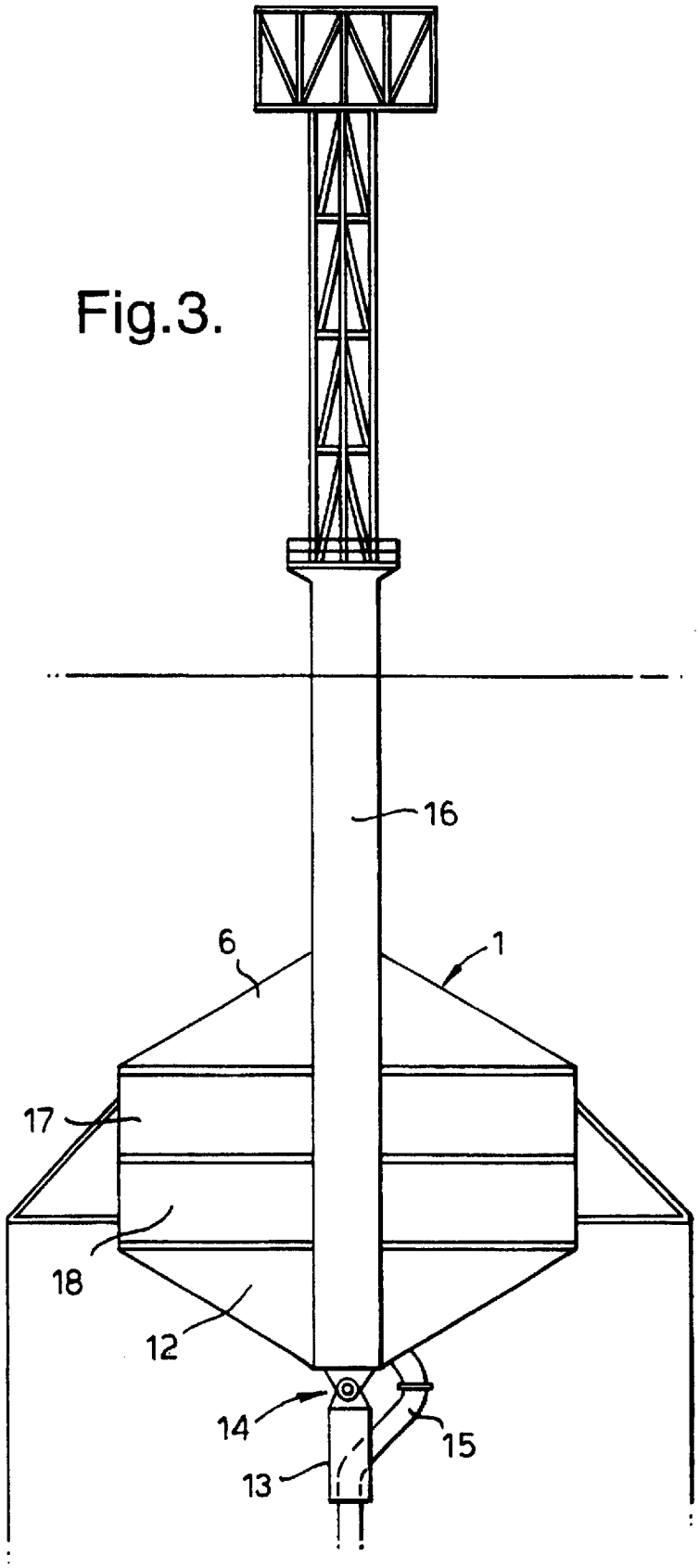
FIG. 3 illustrates a second form of buoyant structure in accordance with the invention.

Referring next to FIG. 3, this embodiment is generally similar to that of FIG. 2 except that the housing 1 is wider and shallower than is the case with FIG. 2. The central cylindrical part of the housing comprises just two levels, namely an upper process deck 17 and a lower process deck 18. Other parts have the same function as those in FIG. 2 and carry the same reference numerals.

The shape of the housing 1 in FIG. 3 is advantageous because it approximates to that of a sphere, and this presents close to the minimum theoretical surface area for any given volume. This reduces the impact of external environmental conditions.

Figure 4A:
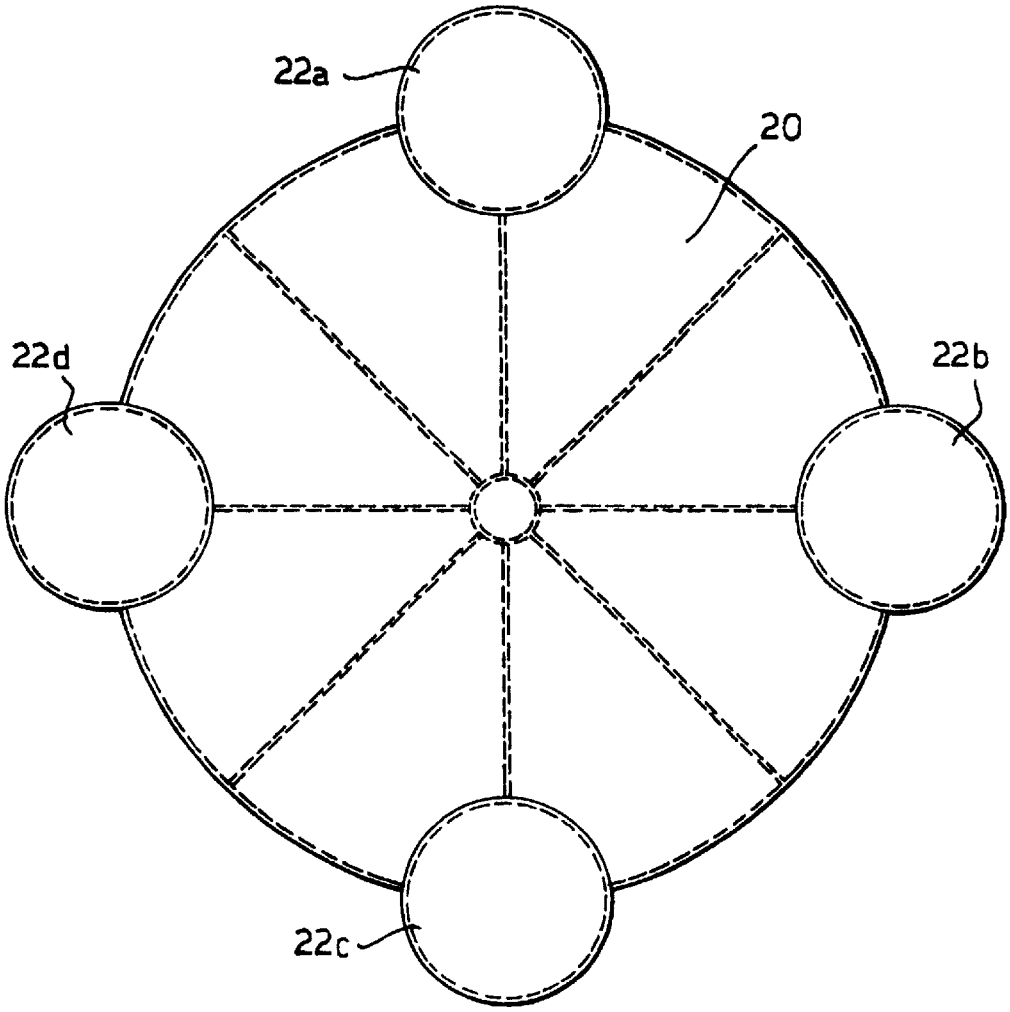
FIG. 4 shows a plan view (FIG. 4*a*) and a side elevational view (FIG. 4*b*) of a gravity base forming part of the invention.
Figure 4B:
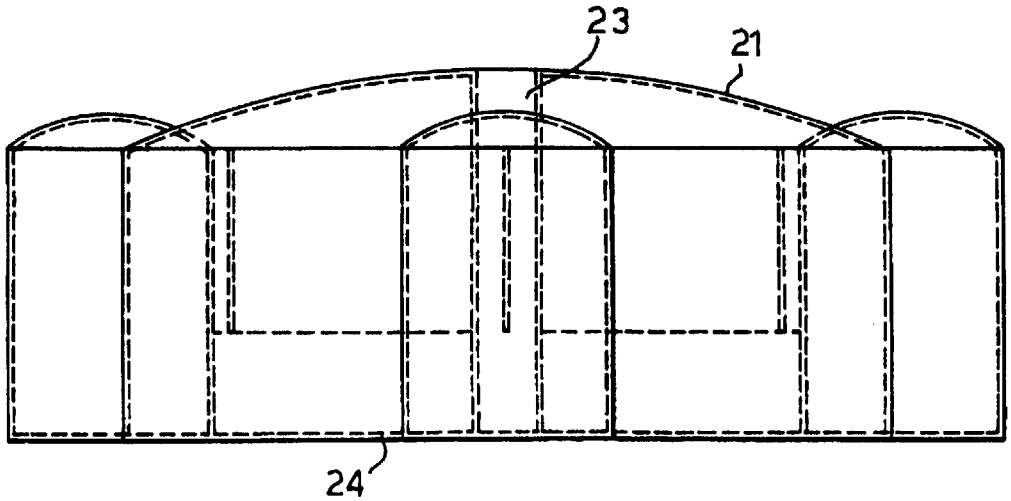
Figure 5:
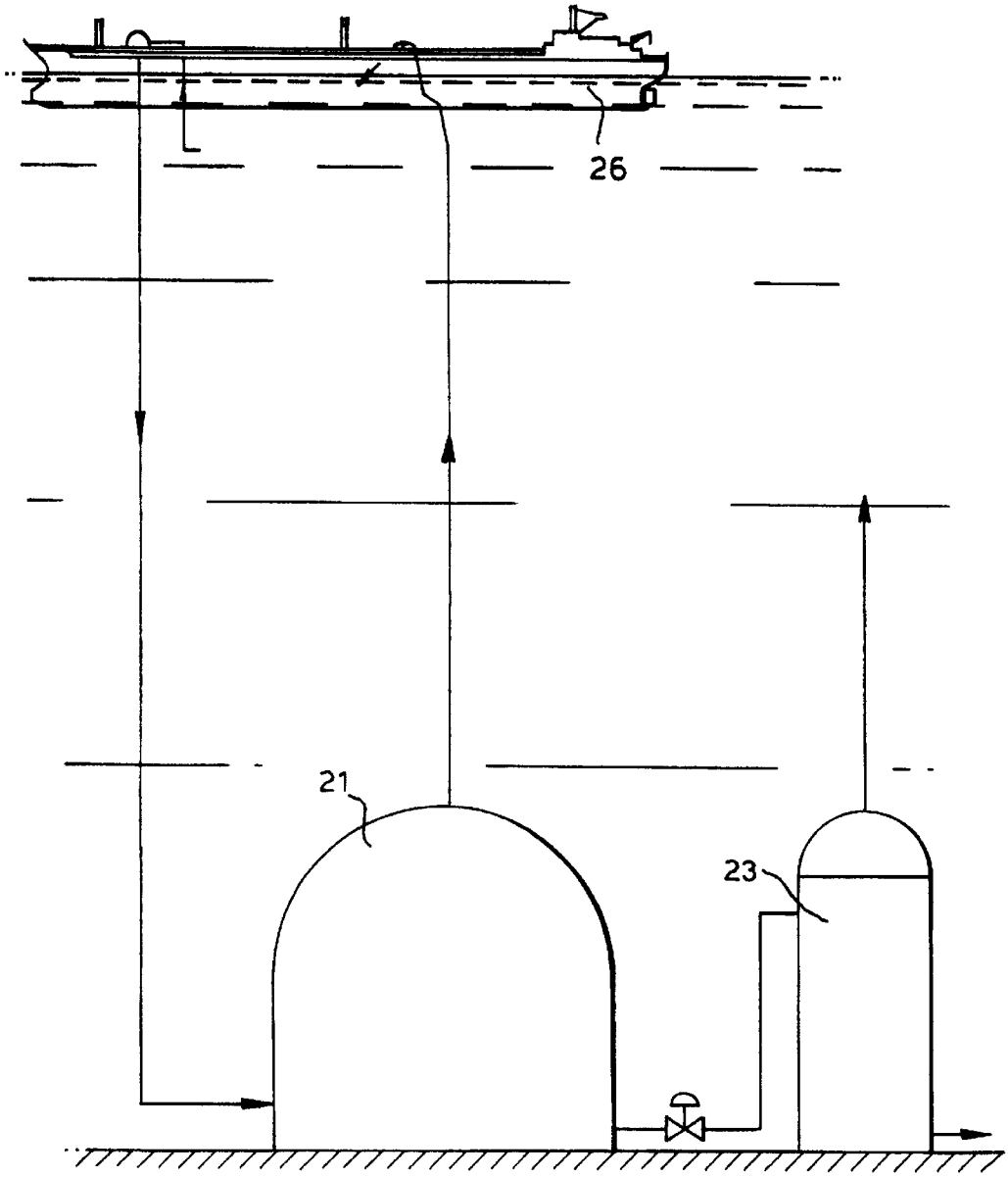
FIG. 5 illustrates schematically an operational cycle involving the base of FIG. 4.

Referring next to FIGS. 4*a* and 4*b*, there is shown a gravity base 20 which is generally circular in plan view and has a domed main storage hull 21 and four concrete ballast chambers 22*a*–22*d*. Typically, oil will be supplied direct from a manifold to supply line 15 for processing within housing 1 (see FIGS. 2 and 3). Processed hydrocarbon fluids are then transferred to the main storage hull 21 of the base, and are exported therefrom to a tanker (26 in FIG. 5) via settling tank 23. The basal wall 24 of this structure can be formed from a reinforced concrete slab.

In an alternative form of construction (not shown), there is no contact between ballast water and hydrocarbon product, thereby dispensing with the need for settling tank 23. However, it is presently preferred to use the illustrated form since the relatively large volume of the tank system allows efficient water/oil separation to occur within the base. This permits the separation of water from oil to take place throughout the entire fill cycle of the basal storage system.

Preferably oil stored in the hull 21 is heated in order to limit or avoid the tendency to produce wax. Such heating may be provided by means of heat transfer coils (not shown) which may operate, for example, using circulated hot water.

A preferred operating regime for the illustrated oil storage system commences with the hull 21 full of sea water. Oil or oil and produced water are then introduced from the housing 1 into hull 21 at relatively low velocities, thereby displacing sea water. This sea water, together with any produced water introduced along with the oil, then enters settling compartment 23 where it remains for a residence time sufficient to allow adequate separation of residual oil. Oil is discharged from the storage system to a tanker 26 and seawater ballast is introduced to replace the oil. This seawater may be introduced into the system through settling tank 23 or a seawater pumped downwardly by the tanker to load the oil by seawater displacement. Such an operating scheme is illustrated schematically in FIG. 5.

What is claimed is:

1. An apparatus for offshore production of hydrocarbon fluids, comprising a base and a buoyant structure secured to said base and connected or adapted to be connected to a subsea well or wells, characterised in that: (a) the base includes storage facility means for fluid(s) received from the subsea well or wells and/or for processed fluid(s) produced by the apparatus, (b) said buoyant structure includes (i) a sub-surface housing having facilities for processing the fluid(s) received from subsea well or wells via said storage facility in said base, and (ii) a column extending upwardly from said housing to a level above the sea surface, and (c) said housing is connected to the base by a riser and the housing is also tethered to said base by a plurality of flexible tethers, the tethers being attached to the housing by outriggers.

2. Apparatus as claimed in claim 1 wherein said storage facility means comprises ancillary buoyant tethered storage units.

3. Apparatus as claimed in claim 1, wherein said base is a gravity structure.

4. Apparatus as claimed in claim 1, wherein said buoyant structure is connected directly to a sub-sea wellhead.

5. Apparatus as claimed in any preceding claim, wherein said sub-surface housing comprises a cylindrical section located between upper and lower conical sections.

* * * * *